US006983119B2

(12) United States Patent
Nakayama

(10) Patent No.: US 6,983,119 B2
(45) Date of Patent: Jan. 3, 2006

(54) IMAGE HEATING APPARATUS WITH GLASS SELECTOR

(75) Inventor: Junichi Nakayama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 10/721,469

(22) Filed: Nov. 26, 2003

(65) Prior Publication Data

US 2004/0151515 A1 Aug. 5, 2004

(30) Foreign Application Priority Data

Nov. 29, 2002 (JP) ..... 2002-347909

(51) Int. Cl.
*G03G 15/20* (2006.01)

(52) U.S. Cl. ..... 399/341; 219/216; 399/67; 399/329

(58) Field of Classification Search ..... 399/67, 399/68, 329, 328, 320, 322, 341; 219/216, 219/243, 388; 347/156; 430/124
See application file for complete search history.

(56) References Cited

U.S. PATENT DOCUMENTS

| | | | | |
|---|---|---|---|---|
| 5,666,624 | A | 9/1997 | Kanesawa et al. | 399/329 |
| 2002/0085082 | A1 * | 7/2002 | Takeuchi et al. | 399/68 X |
| 2002/0102118 | A1 * | 8/2002 | Kosugi et al. | 399/341 |
| 2004/0042809 | A1 * | 3/2004 | Fuma et al. | 399/67 |
| 2004/0161271 | A1 * | 8/2004 | Tanino et al. | 399/329 |

FOREIGN PATENT DOCUMENTS

| | | |
|---|---|---|
| JP | 9-34291 | 2/1997 |

* cited by examiner

*Primary Examiner*—Sophia S. Chen
(74) *Attorney, Agent, or Firm*—Fitzpatrick, Cella, Harper & Scinto

(57) ABSTRACT

An image heating apparatus includes: a heating member for heating a toner image formed on a recording material; a plurality of pressure members for pressurizing the heating member to form a nip portion where the recording material is nipped and transported, in which a pressurizing force is changeable, the pressure members being arranged along a transport direction of the recording material; a gloss selector for selecting a gloss of an image to be formed; and a pressurizing force selector for selecting the pressurizing forces of the pressure members independently of one another according to the gloss selected by the gloss selector.

6 Claims, 8 Drawing Sheets

IMAGE HEATING APPARATUS WITH GLASS SELECTOR

BACKGROUND OF THE INVENTION

1. Field of the Invention

The present invention relates to an image heating apparatus. In general, an image forming apparatus adopting an electrophotographic process generally has a fixing device (an image heating apparatus) that fuses and fixes a toner image through heat and pressure application as follows. That is, a recording material and a toner electrostatically carried on the recording material are nipped and transported at a pressure contact portion (nip portion) between heating means (roll, endless belt member, etc.) and pressure means (roll, endless belt member, etc.), which come into pressure contact with each other in a rotatable manner, the toner being formed of a resin, a magnetic material, a colorant, etc.

2. Related Background Art

FIG. 8 shows a structure of a belt-nip type fixing device as disclosed in JP H09-034291 A. Proposed in the publication is the device having: a rotatable heating roll 101 including a heat source; an endless belt 102 coming into pressure contact with the heating roll 101 and rotating in accordance with the rotation of the heating roll 101; a pressure roll 103*a* which is provided at the end on a downstream side of a contact nip area N between the heating roll 101 and the endless belt 102 and adapted to stretch the endless belt 102; and an assist pad 104 provided inside the endless belt 102 and adapted to pressurize the endless belt 102 against the heating roll 101. Here, the endless belt 102 is rotatably stretched over the pressure roll 103*a* and plural support rolls 103*b* and 103*c*.

In such a belt-nip type fixing device, the pressure roll 103*a* enables a recording material 105 to peel off at an outlet of the contact nip area N, i.e., self-stripping, while requiring no stripping claw even in the case of fixing the toner image in a large toner amount onto the recording material in a thin paper form, which is low in stiffness. That is, in general, the heating roll 101 has an elastic layer constituting its surface. When the pressure roll 103*a* comes into pressure contact with the elastic layer, the surface of the heating roll 101 elastically deforms at a pressure contact area between the heating roll 101 and the pressure roll 103*a*, and the recording material 105 passing between the heating roll 101 and the pressure roll 103*a* is guided in such a direction as to peel off from the heating roll 101.

However, if the pressure of the pressure roll 103*a* is excessively increased for improving a self-stripping performance, there occurs a phenomenon that an unfixed toner image 106 on the recording material 105 is offset. This phenomenon results from the fact that the high pressure of the pressure roll 103*a* causes the elastic layer on the heating roll 101 to excessively deform, leading to an increased moving speed of the recording material 105. To cope with the image offset, the pressure pad 104 is provided. In other words, the pressure pad 104 is used to pressurize the heating roll 101 in a wide range on an upstream side of the pressure roll 103*a* within the contact nip area N. Thus, it is unnecessary to excessively increase the pressure applied to the heating roll 101 from the pressure roll 103*a*, thereby preventing the image offset.

If an electrophotograph having a glossiness equivalent to printed matter is demanded, the gloss of a fixed toner image needs to be increased. As understood from the above, the fixing device adaptable to glosses in a wide range is desired. To attain this, a method of changing a surface temperature of the heating roll or changing a time for passing the nip may be adopted. However, in the method of changing the surface temperature of the heating roll, since a heat quantity of the heating roll is large, when a rate at which the temperature is changed is large, the image formation cannot be carried out until the temperature is changed to the target temperature, which undesirably results in a remarkable decrease in productivity. On the other hand, the method of changing the time for passing the nip involves the following problems.

The time for passing the nip is defined as a numerical value calculated from the equation of nip width (mm)/sheet speed (mm/s), which corresponds to a heating time of the recording material and the toner. FIG. 7 shows a relationship between a toner surface gloss and the time for passing the nip with a uniform area pressure in the nip. In this experiment, the time for passing the nip is changed by changing a process speed, but the same effects can be obtained also by changing the nip width. A controlled temperature of the heating roll is set constant at 190° C. during the experiment. With a relatively high pressure of 3 kg/cm$^2$, the gloss increases up to 90% in accordance with the increase of the time for passing the nip. On the other hand, with a relatively low pressure of 1.5 kg/cm$^2$, the gloss increases up to 50% but when the gloss exceeds 50%, the gloss experiences a downturn in increase. With a much lower pressure of 0.5 kg/cm$^2$, when the gross is not less than 20 to 30%, the gloss tends to experience a downturn in increase.

A glossiness detecting method is for measuring a glossiness based on JIS Z8741. That is, as for a measurement method, a luminous flux is made incident on the recording material surface at a stipulated angle of incidence with a stipulated angle of aperture to thereby measure the luminous flux reflected in a mirror reflection direction with the stipulated angle of aperture by a photo-detector 1090. In FIG. 9, the luminous flux irradiated from a light source 1080 passes through a lens and enters a recording material P at an incident angle θ. The luminous flux reflected in the mirror reflection direction is detected by the photo-detector 1090 through a lens 1100. The detection is performed on the surface glossiness with the incident angle θ set to 60°.

On the other hand, a fixability that the toner image is fixed onto the recording material is mainly largely affected by the heat quantity for fusing the toner, if a given pressure is applied. This imposes a limitation on a lower limit to which the time for passing the nip can be minimized. As a result, in the method of changing the time for passing the nip, a gloss change range is narrow.

However, as apparent from FIG. 7, the gloss increases if the pressure is increased.

This is supposedly achieved on the following two grounds.

First, in the case of the toner containing oil as a mold release agent, the pressure at the nip portion is increased, so that the oil easily leaks from the toner, with the result that the oil adheres to the heating roll to improve a mold release property of the heating roll to the toner. Therefore, it is possible to form a smooth fixed toner image. Second, in the case of the heating roll having an elasticity, the surface of the heating roll is pulled due to the pressure at the nip portion when the pressure is high, thereby increasing a smoothness of the surface of the heating roll within the nip, so that the smoothness of the fixed toner image is increased.

Further, while the minimum pressure is set, the time for passing the nip is secured, so that the fixability can be assured.

In this way, the gloss control can be made in a wide range by changing the pressure without changing the time for passing the nip.

In the structure of FIG. 8, when the pressure is changed to the plural different pressures using one planer pressure member, the pressure change range should be made narrow. In particular, with one planer pressure member, any error is likely to occur with respect to a variation and thus, the target gloss cannot be obtained. Therefore, the pressure change range should be made wide.

SUMMARY OF THE INVENTION

An object of the present invention is to provide an image heating apparatus capable of outputting a glossy image in a wide range.

Another object of the present invention is to provide an image heating apparatus capable of finely changing a pressurizing force with a simple structure.

Still another object of the present invention is to provide an image heating apparatus including: a heating member for heating a toner image formed on a recording material; a plurality of pressure members for pressurizing the heating member to form a nip portion where the recording material is nipped and transported, in which a pressurizing force is changeable, the pressure members being arranged along a transport direction of the recording material; gloss selecting means for selecting a gloss of an image to be formed; and pressurizing force selecting means for selecting the pressurizing forces of the pressure members independently of one another according to the gloss selected by the gloss selecting means.

Other objects of the present invention will be apparent upon reading the following description.

DESCRIPTION OF THE PREFERRED EMBODIMENTS (Embodiment 1)

(1) Example of Image Forming Apparatus

Figure 1:
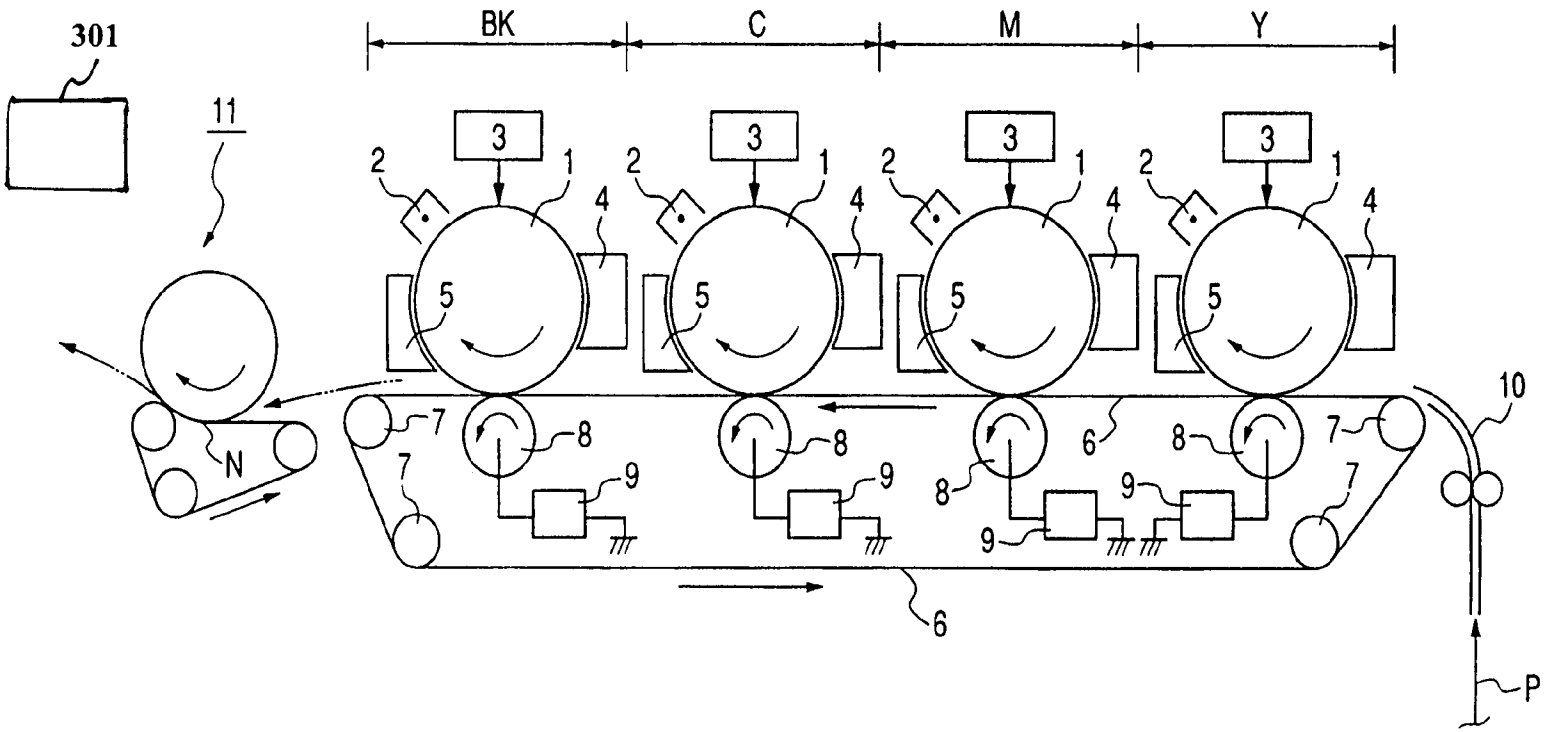
FIG. 1 is a schematic sectional view of an image forming apparatus according to the present invention.

FIG. 1 is a model view showing a schematic structure of an image forming apparatus of an embodiment of the invention. The image forming apparatus of the embodiment is a tandem type full-color printer adopting an electrophotographic process.

Reference symbols Y, M, C, and BK denote four stations, i.e., first to fourth visual image forming stations arranged in the stated order from the right side to the left side in FIG. 1.

The visual image forming stations Y, M, C, and BK each constitute an electrophotographic process mechanism composed of, for example, a rotational drum type electrophotographic photosensitive member 1 as an image bearing member; a charger 2 as charging means for charging a surface of the photosensitive member 1; an exposure device 3 such as a laser scanner or an LED array as exposure means for forming a latent image on the charged photosensitive member 1; a developing device 4 as developing means for visualizing the latent image formed on the photosensitive member 1 with a toner; a transfer device 8 as a transfer rotating member for transferring the toner image on the photosensitive member 1 to a recording material; and a cleaning device 5 as cleaning means for removing a transfer residual toner on the photosensitive member. The photosensitive member 1 is rotated at a predetermined peripheral speed clockwise as indicated by the arrows in FIG. 1.

The first visual image forming station Y forms a toner image in yellow constituting a full-color image on the surface of the photosensitive member 1. The second visual image forming station M forms a toner image in magenta constituting the full-color image on the surface of the photosensitive member 1. The third visual image forming station C forms a toner image in cyan constituting the full-color image on the surface of the photosensitive member 1. Then, the fourth visual image forming station BK forms a toner image in black constituting the full-color image on the surface of the photosensitive member 1. Since toner image formation principle and process in the respective visual image forming stations are well known, a description thereof is omitted here.

Reference numeral 6 denotes a transfer belt as a transfer rotating member stretched to extend over plural support rolls 7 and provided to stretch across all the first to fourth visual image forming stations Y, M, C, and BK at the lower portions thereof. The transfer belt 6 is rotated counterclockwise as indicated by the arrows in FIG. 1 at a preset peripheral speed corresponding to that of the photosensitive member 1.

Reference numeral 8 denotes a transfer electrode roll as transfer means, which comes into pressure contact with the lower surface of the photosensitive member 1 through the transfer belt 6 in each of the first to fourth visual image forming stations Y, M, C, and BK to form a transfer nip portion. Denoted by 9 is a power source for applying a transfer bias to each transfer electrode roll 8, which applies a predetermined voltage of a potential reverse to a charge polarity of the toner as the transfer bias at a predetermined control timing.

A recording material feed path 10 is used to feed sheets P as the recording material separated one by one and fed from a sheet feeding mechanism (not shown), to an end on the first visual image forming station Y side of the transfer belt 6. The transfer belt 6 having the fed sheet P electrostatically attracted and held thereon or held with a chuck transports the sheet through the transfer nip portions in the order of the first to fourth visual image forming stations Y, M, C, and BK. As a result, a yellow toner image, a magenta toner image, a cyan toner image, and a black toner image are successively superimposed and transferred onto the same surface of the sheet P in an aligned form to form the full-color toner image through synthesis.

The sheet P transported to pass through the transfer nip portion of the fourth visual image forming station BK is separated from the transfer belt 6 to be introduced into a fixing device 11 where an unfixed toner image is fixed, after which the sheet is transported and delivered.

Here, the toner used in the present invention will be described. The toner used in this embodiment is formed by, for example, a polymerization method. Wax or oil components as a mold release agent are encapsulated into the toner. Note that the present invention is not limited to the polymerization method as long as the toner containing the wax or oil is produced.

(2) Fixing Device

Figure 2A:
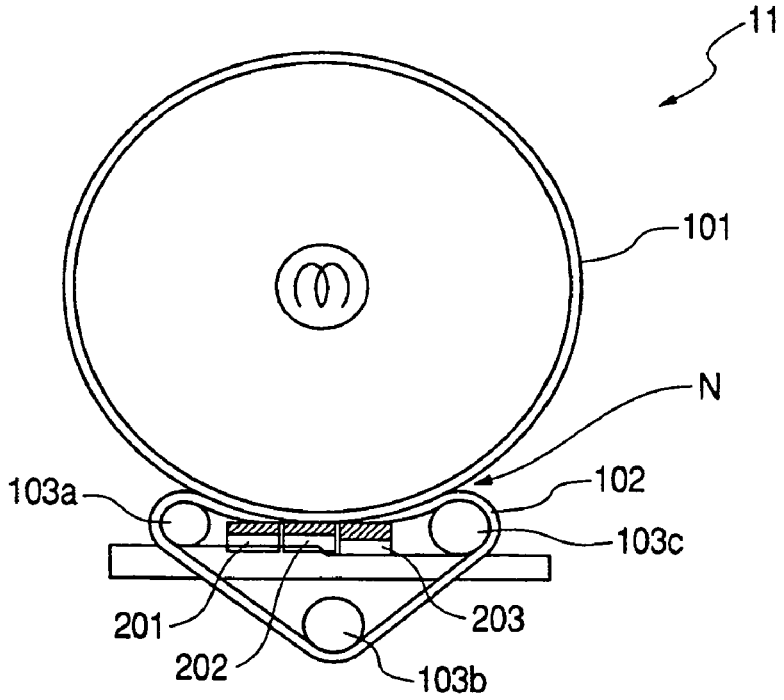
FIGS. 2A and 2B are a schematic sectional view and a side view of a fixing device according to the present invention, respectively.
Figure 2B:
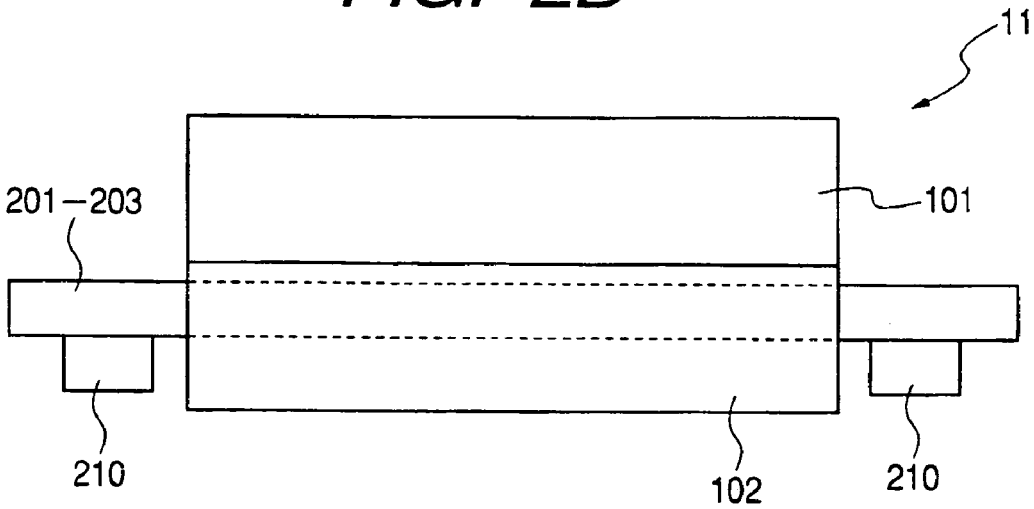

Referring to FIGS. 2A and 2B, the fixing device 11 as an image heating apparatus of the present invention is described in detail. FIGS. 2A and 2B are a sectional view and a side view of the fixing device 11, respectively.

As shown in FIG. 2A, a planer pressure member as a pressure member within the nip is so divided as to change a pressurizing force in a transport direction of the recording material independently. The fixing device includes: a heating roll 101 as a rotatable heating member including a heating element such as a halogen heater as a heat source; an endless belt 102 coming into pressure contact with the heating roll 101 and rotating in accordance with the rotation of the heating roll 101; a pressure roll 103*a* which is provided at the end on a downstream side of a contact nip area N where the heating roll 101 and the endless belt 102 come into contact with each other to nip and transport the recording material and adapted to stretch the endless belt 102; and planer pressure members 201, 202, and 203 as pressure members provided inside the endless belt 102 and adapted to pressurize the endless belt 102 against the heating roll 101. Here, the endless belt 102 is rotatably stretched over the pressure roll 103*a* and support rolls 103*b* and 103*c*. Also, a surface temperature of the heating roll is controlled to a preset temperature by energization controlling means for controlling an energization amount of the heating element based on a temperature detected by a temperature detecting member such as a non-contact or contact thermistor.

The heating roll is constituted of an aluminum core metal with an outer diameter of 60 mm covered with a silicone rubber layer as an elastic layer with a thickness of 1.5 mm and a PFA tube made of a fluororesin as a mold release layer on its surface. The endless belt has an outer diameter of 60 mm, in which a layer made of the fluororesin such as PFA or PTFE is formed as the mold release layer on a base material made of polyimide. The planer pressure members 201, 202, and 203 that pressurize the belt 102 against the heating roll 101 have a silicone rubber layer as an elastic layer with a thickness of 2 mm on an SUS block, and a glass cloth coated with tetrafluoropolyethylene as the fluororesin is fixedly attached to its upper surface. The embodiment adopts the planer pressure member, but the same effects can be obtained even with the plural pressure rotating members such as pressure rolls. Nip widths in the transport direction at contact surfaces between the planer pressure members 201, 202, and 203, and the heating roll 101 are each 5 mm. The planer pressure members 201, 202, and 203 can be pressurized independently of each other. In this embodiment, the pressure is controlled at two levels of 3 kg/cm$^2$ and 0.5 kg/cm$^2$, by pressure change-over members 210 installed in two positions outside the belt on a front side and an inner side as pressure selecting means for selecting a pressurizing force. An upper surface of the pressure change-over member changes its height at two levels, to pressurize the planer pressure member against the heating roll. The pressure member which is pressurized with the surface at the higher level of the pressure change-over means pressurizes the belt against the heating roll at 3 kg/cm$^2$, whereas the pressure member which is pressurized with the surface at the lower level of the pressure change-over means pressurizes the belt against the heating roll at 0.5 kg/cm$^2$. In the embodiment, the above two levels are adopted, but the level of the pressure change-over means is not limited thereto. The pressure change-over means moves in the transport direction to control the pressurizing force of each of the planer pressure members 201 to 203. FIGS. 3A, 4A, 5A, and 6A are each schematic sectional views in the vicinity of the nip portion under five pressure states while changing a pressure state, and FIGS. 3B, 4B, 5B, and 6B are graphs each showing the pressures in positions in the nip thereof.

Figure 3A:
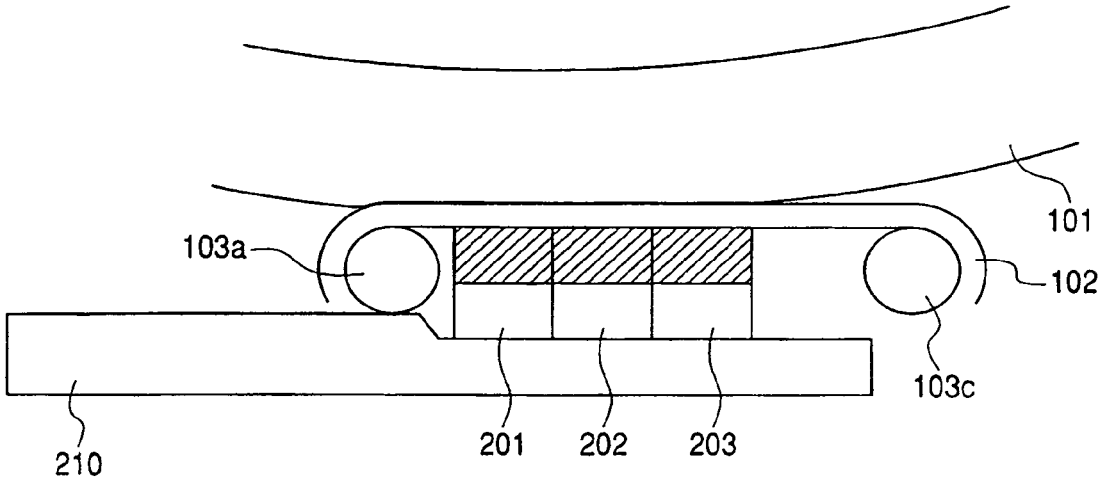
FIG. 3A is an enlarged view of a nip portion for illustrating a pressure state "a" of the fixing device according to the present invention.
Figure 3B:
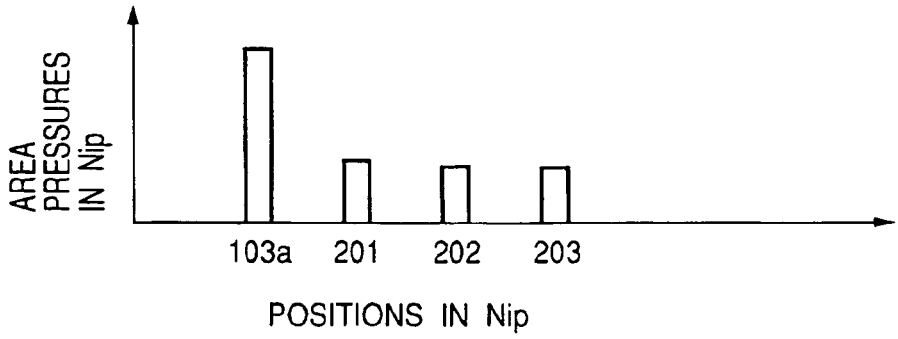
FIG. 3B shows a pressure distribution within the nip portion in the case of the pressure state "a" according to the present invention.
Figure 4A:
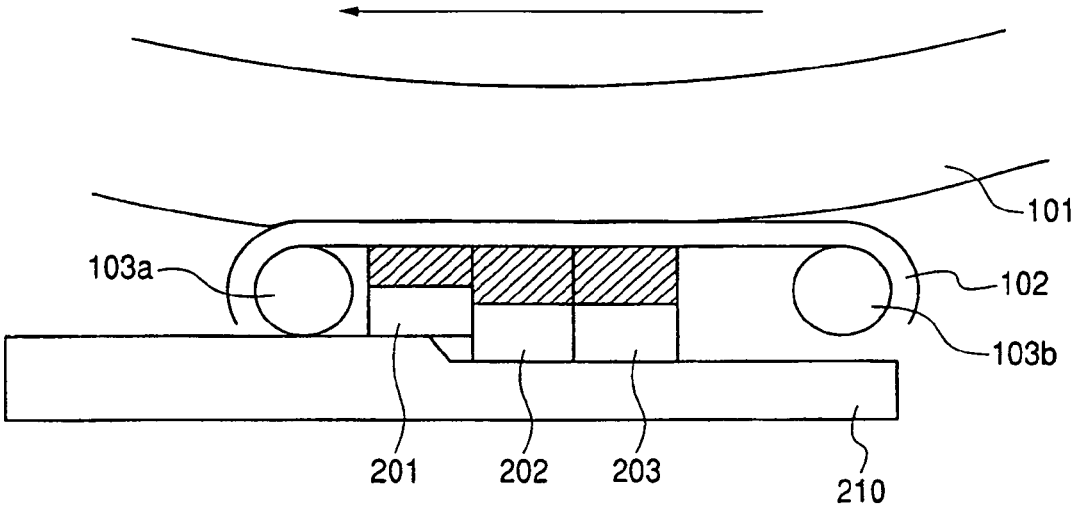
FIG. 4A is an enlarged view of the nip portion for illustrating a pressure state "b" of the fixing device according to the present invention.
Figure 4B:
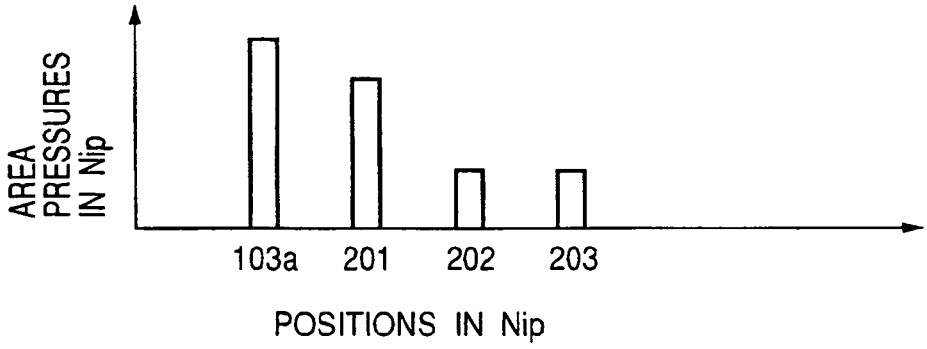
FIG. 4B shows a pressure distribution within the nip portion in the case of the pressure state "b" according to the present invention.
Figure 5A:
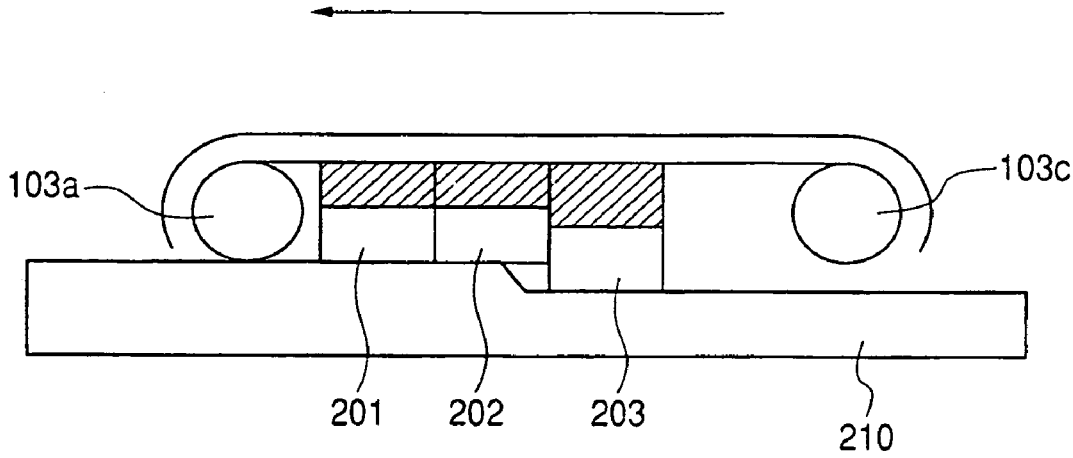
FIG. 5A is an enlarged view of the nip portion for illustrating a pressure state "c" of the fixing device according to the present invention.
Figure 5B:
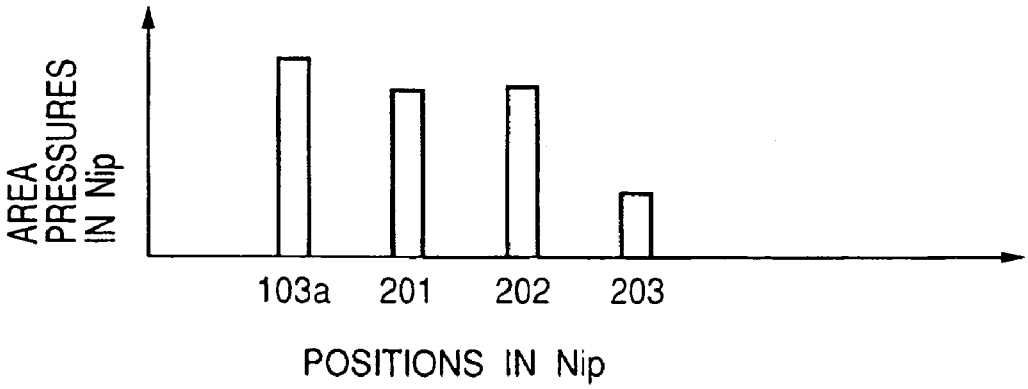
FIG. 5B shows a pressure distribution within the nip portion in the case of the pressure state "c" according to the present invention.
Figure 6A:
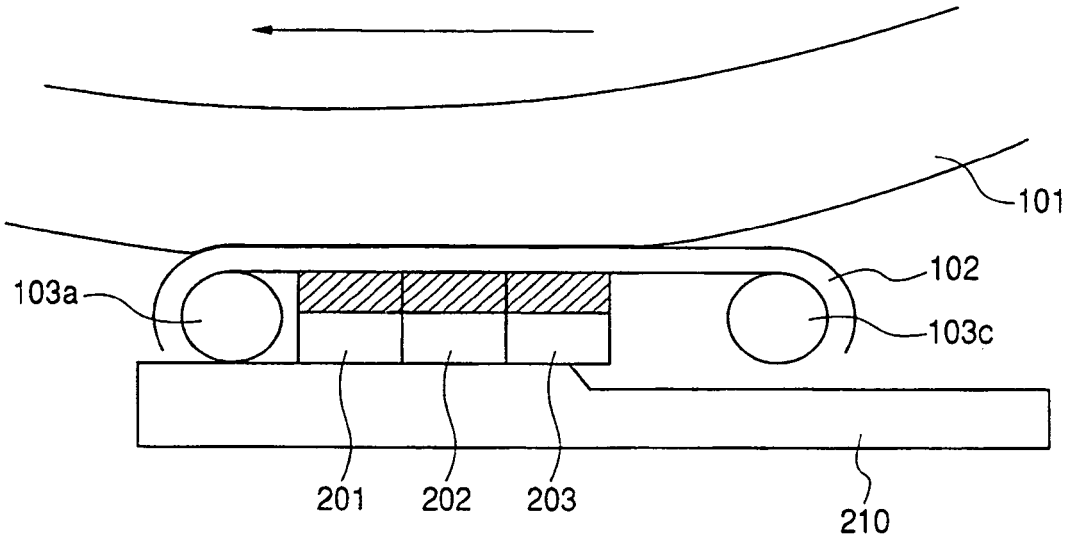
FIG. 6A is an enlarged view of the nip portion for illustrating a pressure state "d" of the fixing device according to the present invention.
Figure 6B:
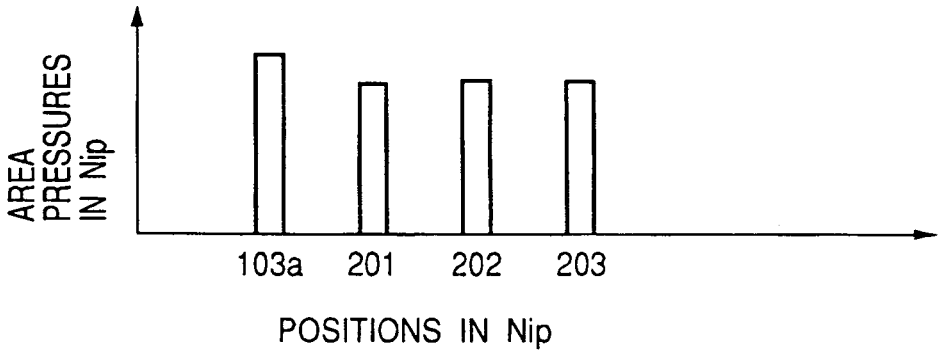
FIG. 6B shows a pressure distribution within the nip portion in the case of the pressure state "d" according to the present invention.
Figure 7:
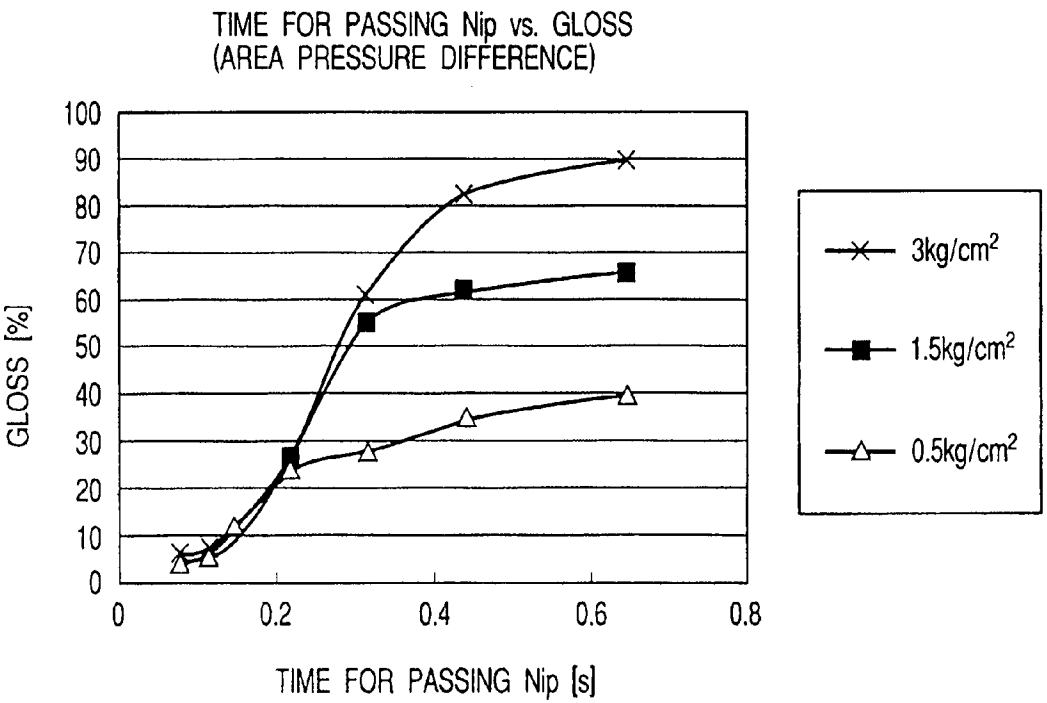
PRIOR ART FIG. 7
FIG. 7 is a graph showing a relationship between a time for passing a nip and gloss with the plural different pressurizing forces.
Figure 8:
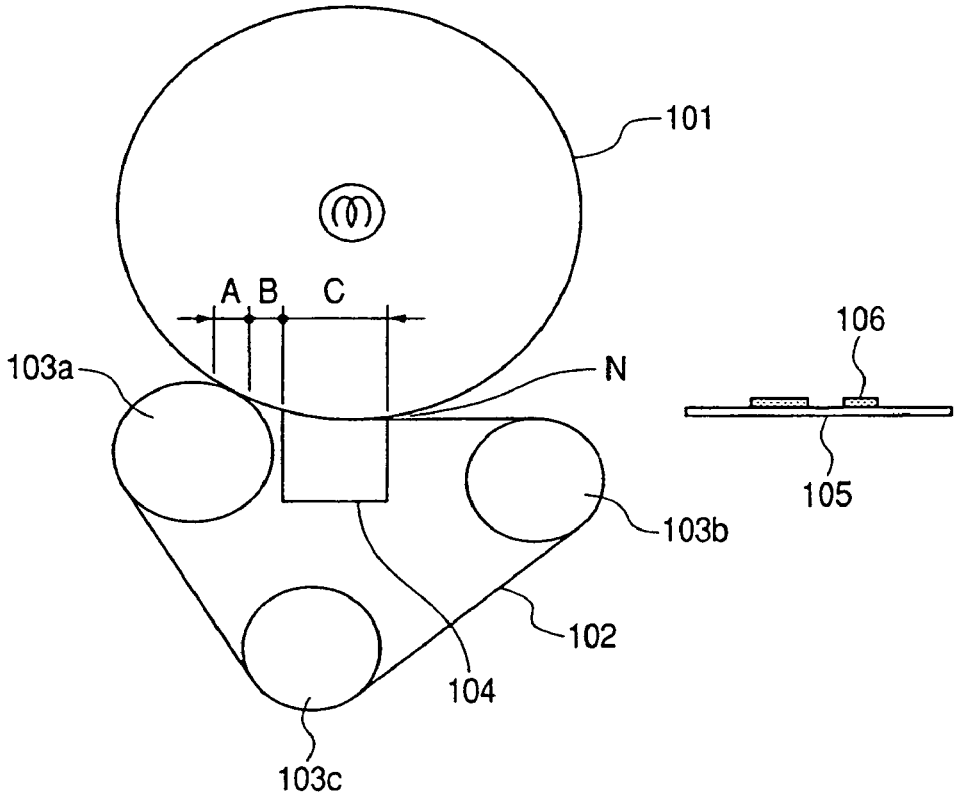
FIG. 8 PRIOR ART
FIG. 8 is a schematic sectional view for illustrating a fixing device using a planer pressure member.
Figure 9:
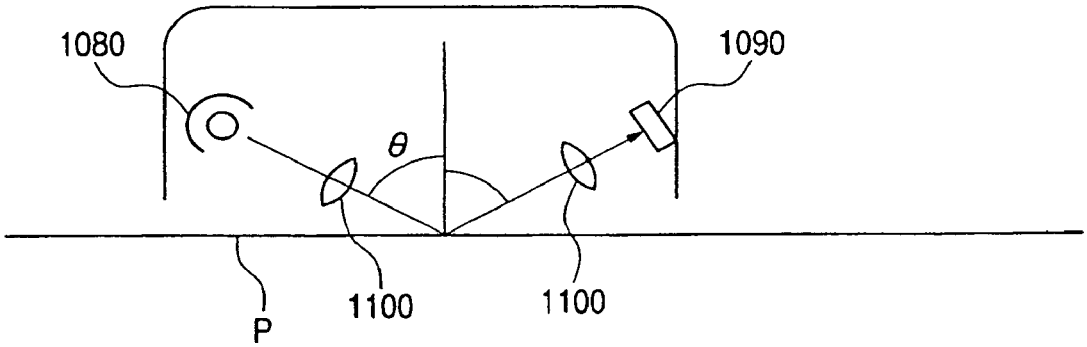
FIG. 9 PRIOR ART
FIG. 9 shows recording material surface glossiness detecting means.

FIGS. 3A and 3B show a state "a" where all the planer pressure members 201 to 203 are applied with the low pressure. FIGS. 4A and 4B show a state "b" where only the planer pressure member 201 is applied with the high pressure of 3 kg/cm$^2$, and the remaining planer pressure members 202 and 203 are applied with the low pressure of 0.5 kg/cm$^2$. FIGS. 5A and 5B show a state "c" where the planer pressure members 201 and 202 are applied with the high pressure of 3 kg/cm$^2$ and the remaining planer pressure member 203 is applied with the low pressure of 0.5 kg/cm$^2$. FIGS. 6A and 6B show a state "d" where all the planer pressure members 201 to 203 are applied with the high pressure of 3 kg/cm$^2$. The width of the pressure members in a high pressure portion is 0 mm, 5 mm, 10 mm, and 15 mm corresponding to the states "a" to "d", respectively. A value obtained through the addition of 3 mm (nip width of a separation roll (pressure roll) part) to the above value is defined as the nip width value at the high pressure portion. The nip width at the high pressure portion corresponding to an area occupied by the high pressure portion in the total pressure area gives a large influence on a gloss in an image area. Thus, the gloss at a fixing roll temperature of 190° C. in the respective states "a" to "d" is 20%, 60%, 75%, and 85% in the states "a", "b", "c", and "d", respectively. As the recording material, one-side coat paper having a basis weight of 150 g/m$^2$ is used. Also, as for a lower limit temperature related to the fixability, the temperatures of 175° C., 175° C., 180° C., and 180° C. are secured with respect to the target lower limit temperature of 180° C. in the states "a" to "d", respectively. Both the desired gloss and the high fixability are attained with a simple method. From the above, the image can be outputted with any image surface gloss according to user's demands.

Here, a relationship between positions in the nip of the planer pressure member and the gloss is described. The planer pressure member positioned on the most upstream side in the transport direction of the recording material gives less influence on the gloss than the member positioned on the most downstream side thereof does. This is because the gloss correlates with the fused state of the toner image on the recording material. When in the well-fused state, the pressure is applied to the toner image, the toner surface layer is largely affected by the pressure. On the other hand, when in the state of not being well-fused, the pressure is applied to the toner image, the toner surface layer is hard to smooth with the pressure. Taking into consideration this respect, the following would be understood. That is, the pressure member positioned on the upstream side in the transport direction of the recording material, at which the toner is not well-fused, less affects the gloss.

The user's demands are related to, for example, the glossiness set by gloss selecting means like a gloss mode set by an operation part 301 of the image forming apparatus or designated by the user. When the user demands to select the gloss mode, he/she can select the desired glossiness from the plural glossinesses of, for example, 20%, 60%, 75%, and 85%. Also, the numbers of planer pressure members at the high pressure (3 kg/cm$^2$) and those at the low pressure (0.5 kg/cm$^2$) are preset when the gloss is selected for each basis weight and each paper type of the recording material. According to gloss information of the recording material, the setting of the planer pressure member is changed and hence, the gloss of the toner image surface according to the gloss of the recording material can be selected. Furthermore, at this point, the fixability can be secured at a high level because the nip width is not changed. In addition, if the gloss mode is not selected, in this embodiment, it is assumed that any setting is previously conducted to carry out a fixing operation in the state "b". The setting may be changed to the other state without causing any problem.

Also, as for a pressure balance of the planer pressure members, the pressure balance between the front portion and the inner portion of the respective pressure members 201 to 203 is measured upon the application of the high pressure and the low pressure, respectively. Each pressure member has only two levels of pressure, and therefore the pressure difference can be made extremely small, i.e., the pressure difference between the front portion and the inner portion can be made as small as 5% or less. Under high temperature/high humidity environment (28° C./80%) as well as low temperature/low humidity environment (15° C./10%), a transport failure of the recording material does not occur, resulting in a good result.

Further, the inlet and the outlet of a fixing nip are secured in positions by the pressure member 203 and the separation roll (pressure roller), respectively, so that a transport path for transfer of the recording material between the upstream side and the downstream side can be stabilized.

In this embodiment, an example is shown in which the pressurizing force of the pressure members is changed while the step-like pressure change-over member is moved in the transport direction. However, even if the pressure members are controlled in pressure by a separate cam etc., although the mechanism is somewhat complicated, the same effects can be exerted as for both the glossiness and the fixability while securing the pressure balance between the front portion and the inner portion for all the settings of the gloss.

Also, taking into account a transport stability of the recording material at the nip portion, the pressure of the pressure member positioned on the most upstream side in the transport direction of the recording material among the plural pressure members is preferably low.

In the embodiment, the gloss can be changed among four levels; however, needless to say, if the number of pressure members variable in pressurizing force is changed, the gloss change level can be more freely set.

In such a way, according to the present invention, the pressure member positioned on the downstream side is used to roughly set the gloss and the fine gloss adjustment is made with the pressure member positioned on the upstream side with the less gloss variation. Thus, the plural gloss images approximate to the gloss that the user demands can be formed.

Also, an area ratio between the high pressure portion and the low pressure portion in the nip portion is variable, so that the gloss in the image forming part is controlled. The number of pressure levels in one pressure member is decreased, so that the pressure difference between the front portion and the inner portion in a longitudinal direction of the nip is suppressed in a relatively simple manner. While securing the stability in transporting the paper, the stable fixability is assured. In addition, with the plural pressure members, the gloss of the toner surface can be controlled in a range of the low gloss to the high gloss.

A contact member on at least one side of the fixing device for holding the recording material at the nip portion, which contacts the recording material, is formed in a belt or film form. The fixing device has a pressure change mechanism that can apply different pressurizing forces in a recording material transport direction, from a rear side of the film in a portion corresponding to the nip. An area ratio between the high pressure portion above a preset threshold and the low pressure portion below the preset threshold is controlled by the pressure change mechanism. While maintaining the fixability, the toner surface gloss can be controlled in a range of the low gloss to the high gloss.

Also, the inlet of the nip and the outlet thereof are secured in positions and the area ratio between the high pressure portion above the preset threshold and the low pressure portion below the preset threshold in the nip is controlled, thereby controlling the gloss of the image forming part. Thus, a stable behavior of the recording material at the transfer portion of the recording material between the upstream side and the downstream side of the fixing device is kept as well as the fixability is assured, while the toner surface gloss can be controlled in a range from the low gloss to the high gloss.

Also, the contact member on at least one side of the fixing device for holding the recording material at the nip portion is formed in a belt or film form. The fixing device has the pressure change mechanism that can control the pressure applied from the rear side of the film at the portion corresponding to the nip portion in a divided form in the recording material transport direction. The pressure change mechanism can apply the pressure at two pressure levels, i.e., the high pressure above the preset threshold and the low pressure below the preset threshold. The area ratio between the high pressure portion and the low pressure portion is controlled, thereby stabilizing the behavior of the paper within the nip portion. In addition, while maintaining the fixability, the toner surface gloss can be controlled in a range from the low gloss to the high gloss. Hereinabove, the embodiment of the present invention has been described. However, the present invention is by no means limited to the above embodiment but may allow any modifications without departing from the technical concept of the present invention.

What is claimed is:

1. An image heating apparatus comprising:

a heating member for heating a toner image formed on a recording material;

a plurality of pressure members for pressurizing the heating member to form a nip portion where the recording material is nipped and transported, in which a pressurizing force is changeable, the pressure members being arranged alone a transport direction of the recording material;

gloss selecting means for selecting a gloss of an image to be formed; and pressurizing force selecting means for selecting the pressurizing forces of said pressure members independently of one another according to the gloss selected by said gloss selecting means wherein when the gloss selected by the gloss selecting means is made high, the large pressurizing force is selected for a pressure member of said pressure members positioned on a downstream side in the transport direction of the recording material.

2. An image heating apparatus according to claim 1, wherein said heating member has a surface layer formed of a fluororesin.

3. An image heating apparatus according to claim 1, wherein said heating member has an elastic layer.

4. An image heating apparatus according to claim 1, wherein said toner contains oil.

5. An image heating apparatus according to claim 1, further comprising a rotatable belt, wherein said pressure members pressurize said heating member through said belt.

6. An image forming apparatus that has unfixed image forming means for forming an unfixed image, comprising an image heating apparatus according to claim 1.

* * * * *

UNITED STATES PATENT AND TRADEMARK OFFICE

CERTIFICATE OF CORRECTION

PATENT NO. : 6,983,119 B2
APPLICATION NO. : 10/721469
DATED : January 3, 2006
INVENTOR(S) : Junichi Nakayama It is certified that error appears in the above-identified patent and that said Letters Patent is hereby corrected as shown below:

TITLE PAGE AT ITEM [54]:
Title, “GLASS” should read --GLOSS--.

COLUMN 1:
Line 2, “GLASS” should read --GLOSS--.

COLUMN 9:
Line 9, “alone” should read --along--.

Signed and Sealed this

Fourth Day of July, 2006

JON W. DUDAS
*Director of the United States Patent and Trademark Office*